US005884401A

United States Patent [19]

Eckardt

[11] Patent Number: 5,884,401

[45] Date of Patent: Mar. 23, 1999

[54] EYE BROW TRIMMING SYSTEM

[76] Inventor: Carole Eckardt, 5478 Appleton Ave. P.O. Box 415, Grayling, Mich. 49738

[21] Appl. No.: 911,546

[22] Filed: Aug. 14, 1997

[51] Int. Cl.[6] ..... B26B 19/04

[52] U.S. Cl. ..... 30/44; 30/29.5; 30/43.92

[58] Field of Search ..... 30/43.92, 44, 29.5, 30/45

[56] References Cited

U.S. PATENT DOCUMENTS 5,007,169 4/1991 Motta ..... 30/43.92

FOREIGN PATENT DOCUMENTS 54-53061 4/1979 Japan ..... 30/43.92

*Primary Examiner*—Douglas D. Watts

[57] ABSTRACT

A new Eye Brow Trimming System for providing a painless, easy and efficient device for removing undesirable hair from a user's eyebrow. The inventive device includes a tube having a battery compartment, a vibrating motor within the tube, a shaft attached to the vibrating motor, an arcuate head having a plurality of apertures, and a plurality of vertical blades attached to the shaft opposite of the motor for cutting hair which projects through the apertures.

1 Claim, 3 Drawing Sheets

EYE BROW TRIMMING SYSTEM

BACKGROUND OF THE INVENTION

1. Field of the Invention

The present invention relates to Brow Shaving Devices and more particularly pertains to a new Eye Brow Trimming System for providing a painless, easy and efficient device for removing undesirable hair from a user's eyebrow.

2. Description of the Prior Art

The use of Brow Shaving Devices is known in the prior art. More specifically, Brow Shaving Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Brow Shaving Devices include U.S. Pat. No. 4,700,477; U.S. Pat. No. 5,333,382; U.S. Design Pat. No. 298,576; U.S. Pat. No. 5,075,971; U.S. Pat. No. 4,972,584 and U.S. Pat. No. 4,216,581.

While these devices fulfill their respective, particular objectives and requirements, the aforementioned patents do not disclose a new Eye Brow Trimming System. The inventive device includes a tube having a battery compartment, a vibrating motor within the tube, a shaft attached to the vibrating motor, an arcuate head having a plurality of apertures, and a plurality of vertical blades attached to the shaft opposite of the motor for cutting hair which projects through the apertures.

In these respects, the Eye Brow Trimming System according to the present invention substantially departs from the conventional concepts and designs of the prior art, and in so doing provides an apparatus primarily developed for the purpose of providing a painless, easy and efficient device for removing undesirable hair from a user's eyebrow.

SUMMARY OF THE INVENTION

In view of the foregoing disadvantages inherent in the known types of Brow Shaving Devices now present in the prior art, the present invention provides a new Eye Brow Trimming System construction wherein the same can be utilized for providing a painless, easy and efficient device for removing undesirable hair from a user's eyebrow.

The general purpose of the present invention, which will be described subsequently in greater detail, is to provide a new Eye Brow Trimming System apparatus and method which has many of the advantages of the Brow Shaving Devices mentioned heretofore and many novel features that result in a new Eye Brow Trimming System which is not anticipated, rendered obvious, suggested, or even implied by any of the prior art Brow Shaving Devices, either alone or in any combination thereof.

To attain this, the present invention generally comprises a tube having a battery compartment, a vibrating motor within the tube, a shaft attached to the vibrating motor, an arcuate head having a plurality of apertures, and a plurality of vertical blades attached to the shaft opposite of the motor for cutting hair which projects through the apertures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Eye Brow Trimming System apparatus and method which has many of the advantages of the Brow Shaving Devices mentioned heretofore and many novel features that result in a new Eye Brow Trimming System which is not anticipated, rendered obvious, suggested, or even implied by any of the prior art Brow Shaving Devices, either alone or in any combination thereof.

It is another object of the present invention to provide a new Eye Brow Trimming System which may be easily and efficiently manufactured and marketed.

It is a further object of the present invention to provide a new Eye Brow Trimming System which is of a durable and reliable construction.

An even further object of the present invention is to provide a new Eye Brow Trimming System which is susceptible of a low cost of manufacture with regard to both materials and labor, and which accordingly is then susceptible of low prices of sale to the consuming public, thereby making such Eye Brow Trimming System economically available to the buying public.

Still yet another object of the present invention is to provide a new Eye Brow Trimming System which provides in the apparatuses and methods of the prior art some of the advantages thereof, while simultaneously overcoming some of the disadvantages normally associated therewith.

Still another object of the present invention is to provide a new Eye Brow Trimming System for providing a painless, easy and efficient device for removing undesirable hair from a user's eyebrow.

Yet another object of the present invention is to provide a new Eye Brow Trimming System which includes a tube having a battery compartment, a vibrating motor within the tube, a shaft attached to the vibrating motor, an arcuate head having a plurality of apertures, and a plurality of vertical blades attached to the shaft opposite of the motor for cutting hair which projects through the apertures.

Still yet another object of the present invention is to provide a new Eye Brow Trimming System that eliminates the need to have the user's eyebrows waxed every other week.

Even still another object of the present invention is to provide a new Eye Brow Trimming System that prevents abrasions to the user as associated with a conventional razor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
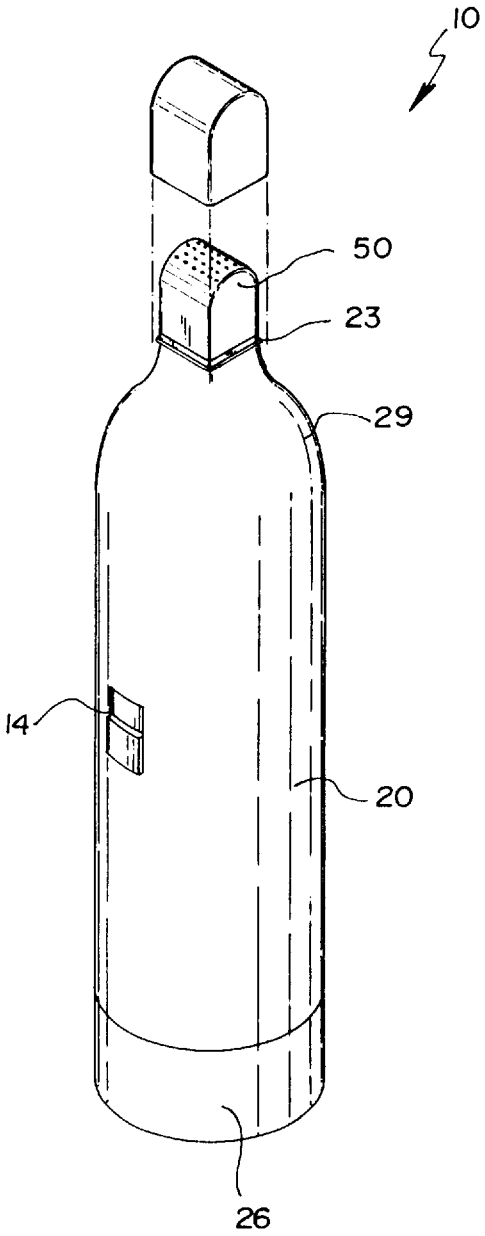
FIG. 1 is a right side perspective view of a new Eye Brow Trimming System according to the present invention.

With reference now to the drawings, and in particular to FIGS. 1 through 6 thereof, a new Eye Brow Trimming System embodying the principles and concepts of the present invention and generally designated by the reference numeral 10 will be described.

More specifically, it will be noted that the Eye Brow Trimming System 10 comprises a tube 20 having a battery compartment 22, a vibrating motor 30 within the tube 20, a shaft 32 attached to the vibrating motor 30, an arcuate head 50 having a plurality of apertures 52, and a plurality of vertical blades 42 attached to the shaft 32 opposite of the motor 30 for cutting hair which projects through the apertures 52.

Figure 4:
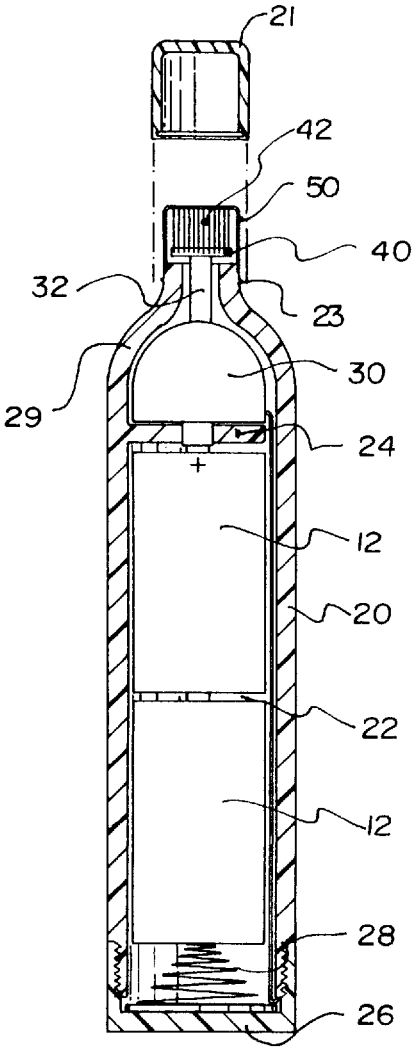
FIG. 4 is a cross sectional view taken along line 4—4 of FIG. 2.
Figure 5:
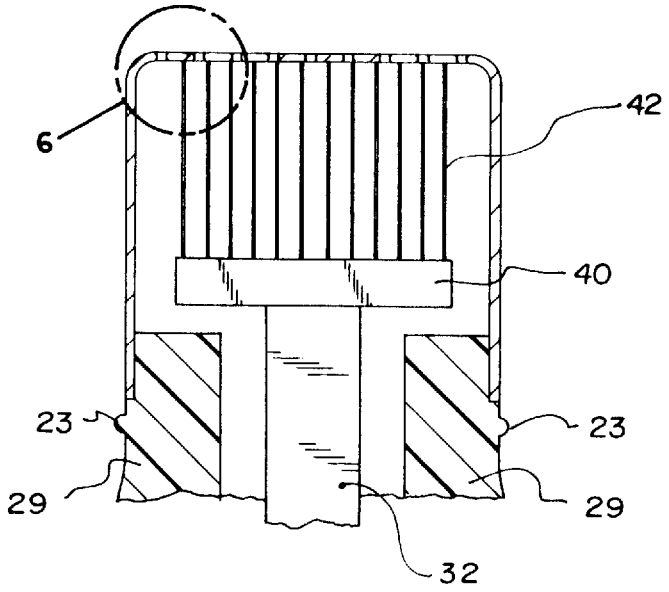
FIG. 5 is a cut-away view of the arcuate head.
Figure 6:
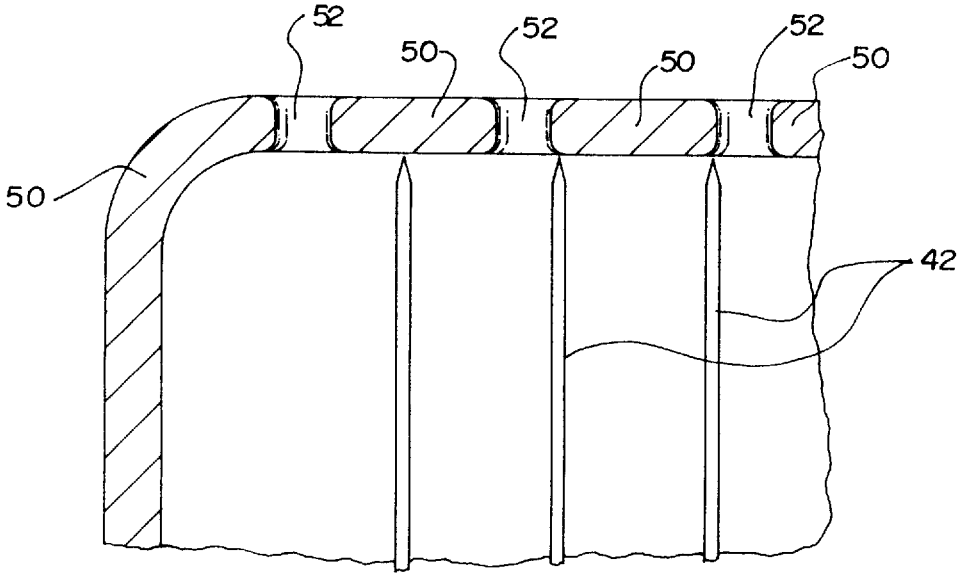
FIG. 6 is a magnified view from FIG. 5 disclosing the apertures within the arcuate head.

As shown in FIGS. 1 through 4, the tube 20 has an open end, a tapering neck 29 opposite of the open end and a partition 24 secured within a lumen of the tube 20 adjacent the tapering neck 29 traverse to a longitudinal axis of the tube 20. A battery compartment 22 projects into the lumen of the tube 20 through the open end for retaining a pair of batteries 12 electrically connected in series. The vibrating motor 30 is secured within the tapering neck 29 of the tube 20 and is electrically connected to the batteries 12 as shown in FIG. 4. A switch 14 is electrically connected between the batteries 12 and the vibrating motor 30 for activating the vibrating motor 30. The shaft 32 is attached to the vibrating motor 30, wherein the shaft 32 projects substantially parallel to the longitudinal axis and is vibrated in a motion traverse to the longitudinal axis as best shown in FIG. 4. A traverse member 40 is secured to the shaft 32 opposite of the vibrating motor 30. The plurality of vertical blades 42 are secured orthogonally to the traverse member 40 extending parallel to one another as shown in FIGS. 4 through 6. The arcuate head 50 has a plurality of apertures 52 and an interior cavity, wherein the apertures 52 receive a length of hair and the vertical blades 42 vibrate within the interior cavity adjacent a ceiling of the arcuate head 50 for cutting the length of hair. A width and a length of the arcuate head 50 is lesser than an average eyebrow width as shown in FIGS. 1, 4 and 5 of the drawings. The tapering neck 29 includes a cincture 23 for securing the lid 21 as shown in FIGS. 1, 4 and 5.

Figure 2:
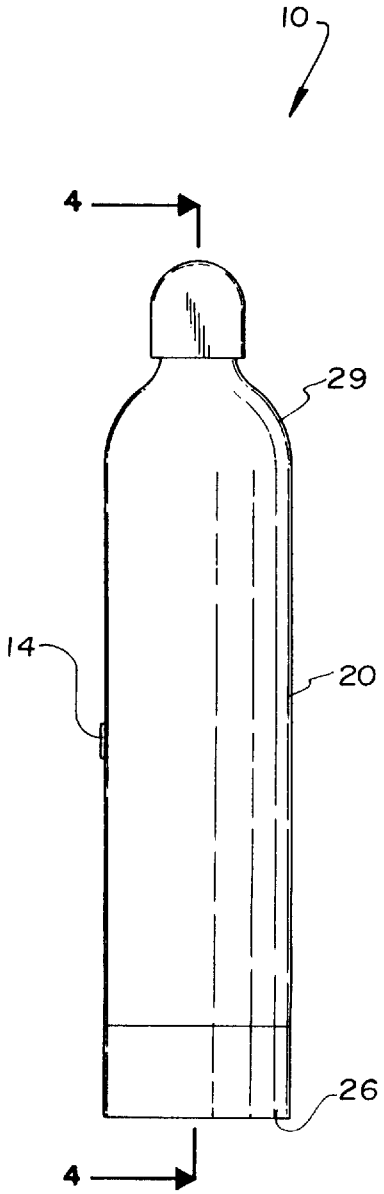
FIG. 2 is a side view of the present invention.
Figure 3:
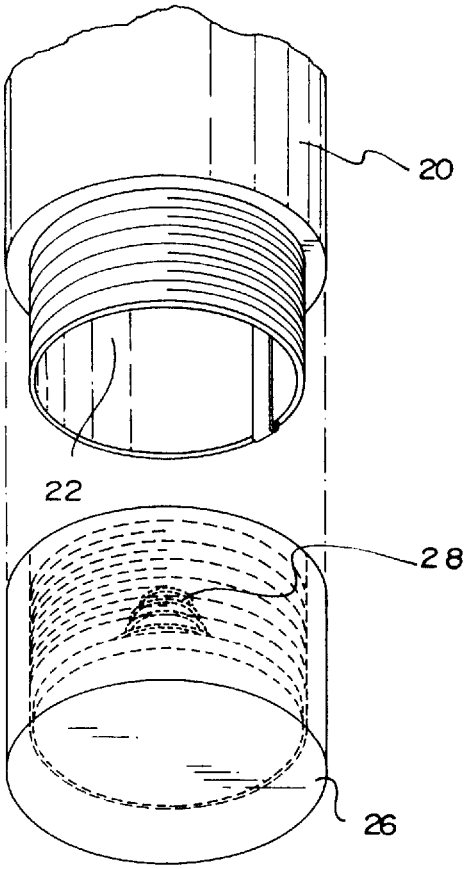
FIG. 3 is a lower perspective view of the threaded cap and the tube.

As shown in FIGS. 1 through 4, a threaded cap 26 has a compression spring 28 secured to an interior surface. The threaded cap 26 threadably engages the open end of the tube 20 for retaining the batteries 12 within the battery compartment 22. A lid 21 is provided for removably attaching to the tapering neck 29 and enclosing the arcuate head 50 as shown in FIGS. 1, 2 and 4 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An Eye Brow Trimming System comprising:

a tube having an open end, a tapering neck opposite of said open end and a partition secured within a lumen of said tube adjacent said tapering neck and traverse to a longitudinal axis of said tube, wherein said lumen of said tube adjacent said open end forms a battery compartment for retaining a pair of batteries electrically connected in series, the tapering neck having a peripheral detent formed thereabout;

a vibrating motor secured within said tapering neck of said tube and electrically connected to said batteries;

a shaft attached to said vibrating motor, wherein said shaft projects substantially parallel to said longitudinal axis and is vibrated in a motion traverse to said longitudinal axis;

a switch electrically connected between the batteries and the vibrating motor for activating the vibrating motor, a traverse member secured to an end of said shaft opposite of said vibrating motor;

a plurality of vertical blades secured orthogonally to said traverse member and extending parallel to one another; and an arcuate head including an inboard extent with a square configuration and an outboard extent with a semi-cylindrical configuration, the outboard extent having a plurality of apertures and an interior cavity, wherein said apertures each have an upper and lower opening which diverse outwardly to receive a length of hair and said vertical blades vibrate within said interior cavity adjacent a ceiling of said arcuate head for cutting said length of hair;

a threaded cap threadably engaging said open end of said tube for retaining said batteries within said battery compartment, said threaded cap having a compression spring thereon for biasing batteries in said battery compartment toward said tapering neck;

a lid including an inboard extent with a square configuration and an outboard extent with a semi-cylindrical configuration, the lid adapted for removably attaching to said tapering neck and enclosing said arcuate head, the lid having a peripheral indent formed thereon for snappily receiving the peripheral detent of the tapering neck of the tube;

wherein a width and a length of said arcuate head is about ½ a diameter of the tube.

* * * * *